United States Patent [19]

Nelson

[11] Patent Number: 4,957,395

[45] Date of Patent: Sep. 18, 1990

[54] PRE-CAST, REINFORCED CONCRETE RETAINING WALL SYSTEM

[76] Inventor: Ned Nelson, 3 Lake Bellevue Dr., #200, Bellevue, Wash. 98005

[21] Appl. No.: 368,028

[22] Filed: Jun. 19, 1989

[51] Int. Cl.[5] ..... E02D 5/20

[52] U.S. Cl. ..... 405/287; 405/285; 52/414; 52/442

[58] Field of Search ..... 405/284–287; 52/415, 438, 442, 586, 602, 426, 169.8

[56] References Cited

U.S. PATENT DOCUMENTS

| | | | |
|---|---|---|---|
| 250,235 | 12/1881 | McLean | 366/342 |
| 721,825 | 3/1903 | Normandin | 52/125.3 |
| 802,593 | 10/1905 | Peabody | 138/115 |
| 1,064,498 | 6/1913 | Landis | 52/125.3 |
| 1,339,388 | 5/1919 | Hauss | 52/325 |
| 1,410,953 | 3/1922 | Peirce et al. | 52/605 |
| 1,415,197 | 5/1922 | Sampson | 52/505 |
| 1,428,470 | 9/1922 | Brainerd | 52/605 |
| 1,578,861 | 3/1926 | Squire | 405/286 X |
| 1,659,326 | 2/1928 | Mayerlord | 52/586 X |
| 2,064,791 | 12/1936 | Faber | 52/586 X |
| 2,141,035 | 12/1938 | Daniels | 202/223 |
| 2,160,773 | 5/1939 | Wolfe | 52/587 |
| 2,234,797 | 3/1941 | Burner | 52/602 |
| 2,313,363 | 7/1940 | Schmitt | 405/286 |
| 3,422,588 | 1/1969 | Stewart | 52/285 |
| 3,472,031 | 10/1969 | Kelso | 405/275 |
| 4,050,254 | 9/1977 | Meheen et al. | 405/285 |
| 4,067,166 | 1/1978 | Sheahan | 52/593 |
| 4,107,894 | 8/1978 | Mullins | 52/593 |
| 4,132,498 | 1/1979 | Ikeda et al. | 405/284 X |
| 4,190,384 | 2/1980 | Neumann | 405/284 |
| 4,592,678 | 6/1986 | McNinch et al. | 405/284 |

FOREIGN PATENT DOCUMENTS

| | | |
|---|---|---|
| 585617 | 9/1933 | Fed. Rep. of Germany . |
| 345117 | 12/1936 | Italy . |

OTHER PUBLICATIONS

"Wallstone, An Interlocking Retaining Wall for Garden Landscaping", Westcon Construction Products, 3 pages.

"Slope-Stone," Westcon Construction Products, 3 pages.

"Technical Manual, Keystone Retaining Wall Systems," 13 pages with 1 page insert (Geogrid Placement Chart).

*Primary Examiner*—Dennis L. Taylor
*Assistant Examiner*—Arlen L. Olsen
*Attorney, Agent, or Firm*—David L. Garrison

[57] ABSTRACT

A lightweight, pre-cast, reinforced, module used to build a structurally engineered retaining wall system. Each module has a panel with a front and rear surface with at least one horizontal reinforcing rod. In the preferred embodiment, a portion of each rod horizontal transverse an integrally attached flange located at each opposite end of the panel. On the outside surface of each flange, there is a recess across which a portion of each reinforcing rod is exposed to be subsequently surrounded by concrete of a poured-in-place reinforced column. A horizontal row of adjacent modules is positioned on a constructed, reinforced footing. The front surface of each module is exposed and each flange is positioned opposite to a flange located on an adjacent module with a column space created between opposite flanges. Alignment elements are attached to the upper surface of each flange and successive horizontal rows of modules are then positioned above until the desired height is achieved. Vertical column forms are attached to the distal and proximal edges of opposite flanges and concrete is poured down into the column space and surrounds all the exposed surfaces. After the concrete has cured, the column forms are removed and the retaining wall structure is completed.

17 Claims, 5 Drawing Sheets

FIG. 2
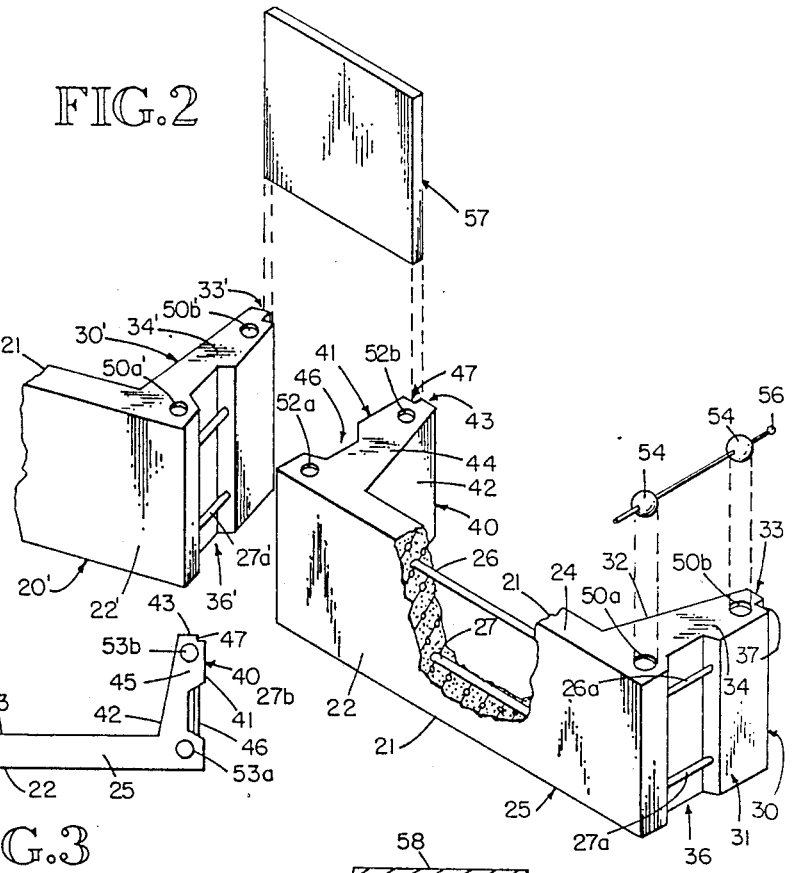
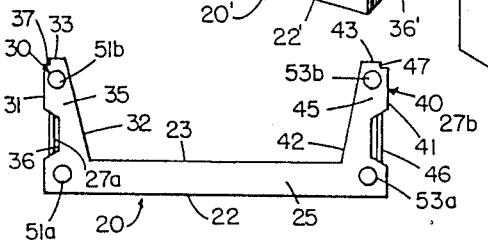
FIG. 3
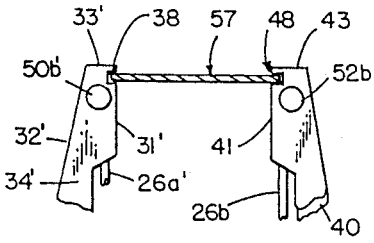
FIG. 4
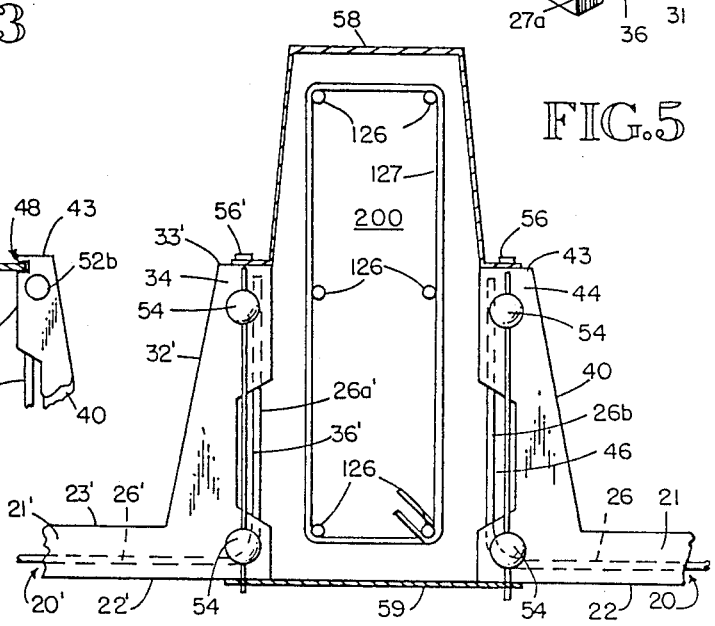
FIG. 5

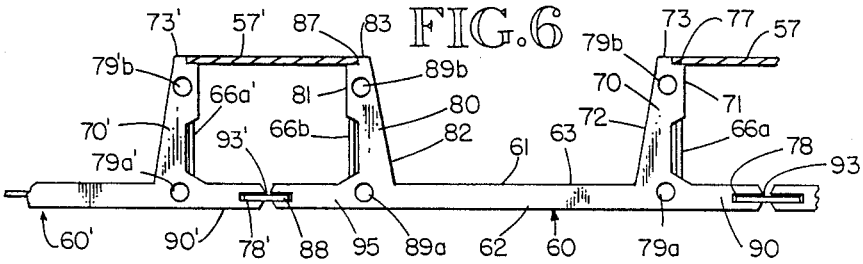
FIG. 6
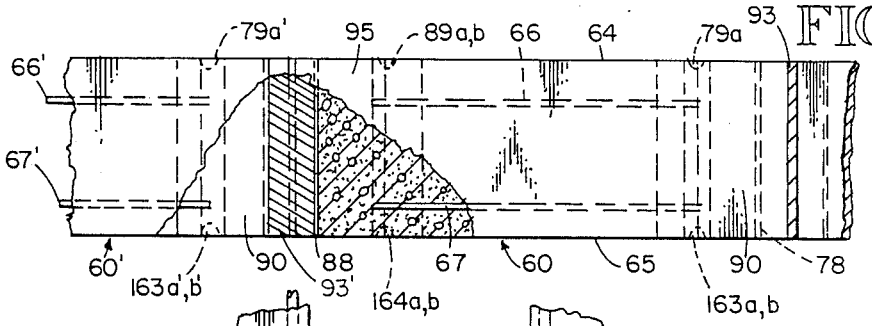
FIG. 7
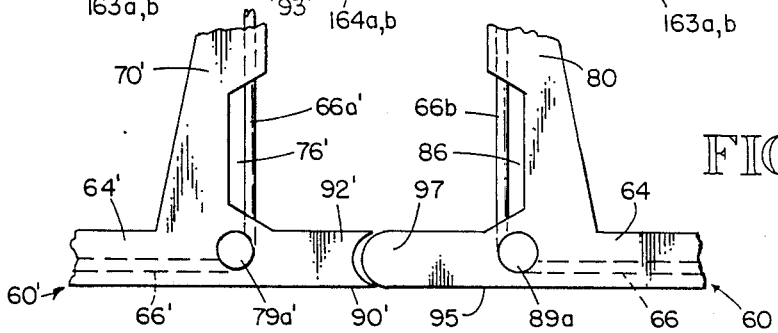
FIG. 8
FIG. 9
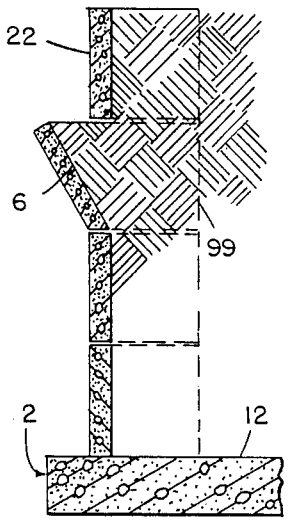
FIG. 10
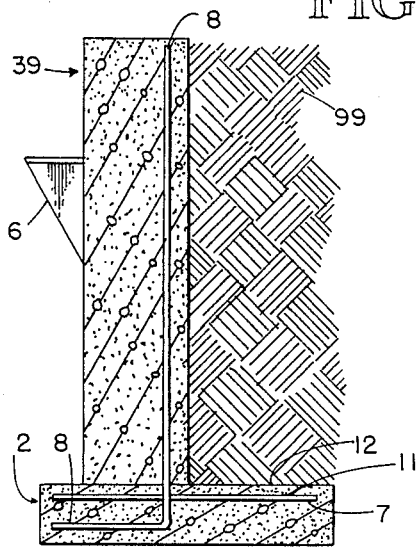

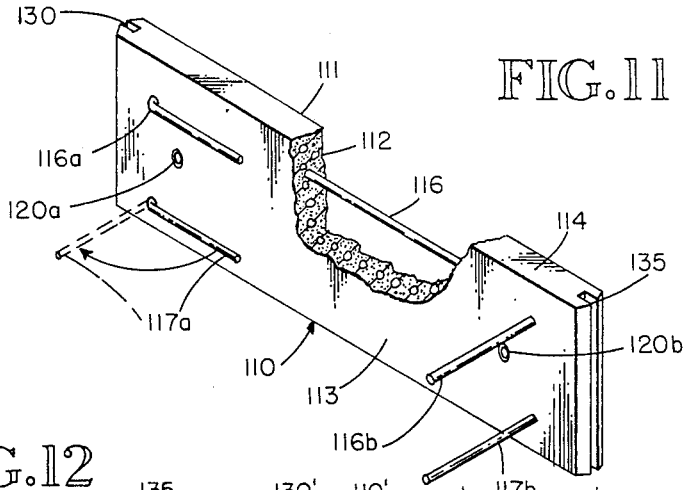
FIG. 11
FIG. 12
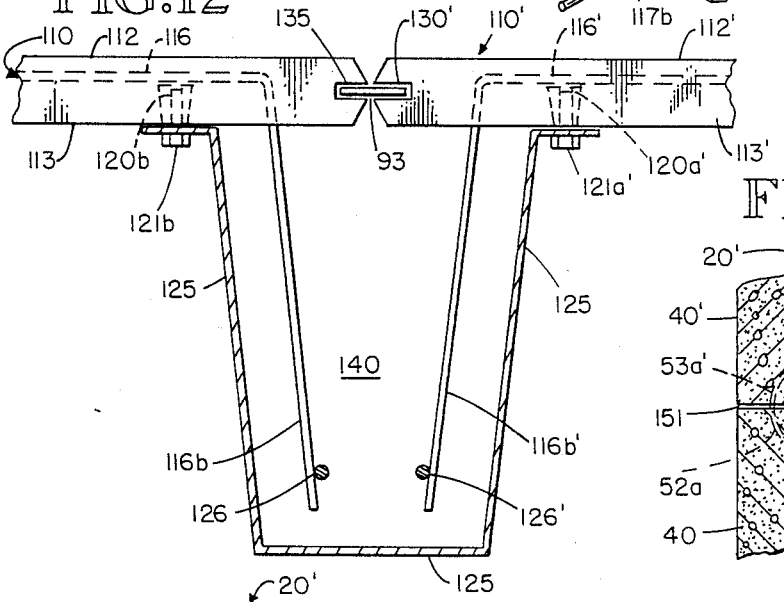
FIG. 13
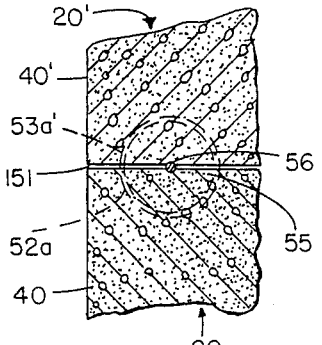
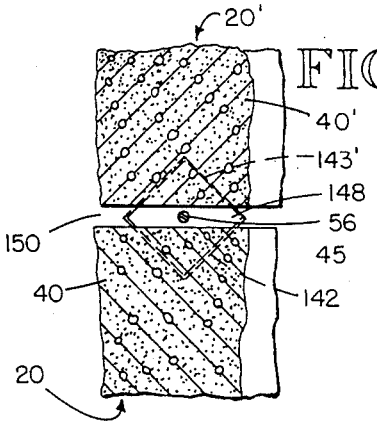
FIG. 14A
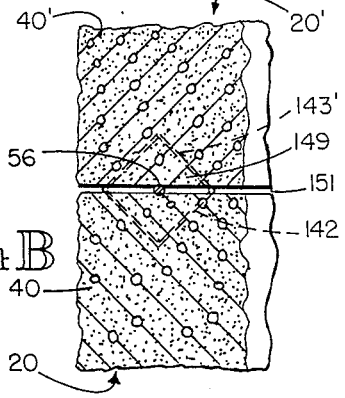
FIG. 14B

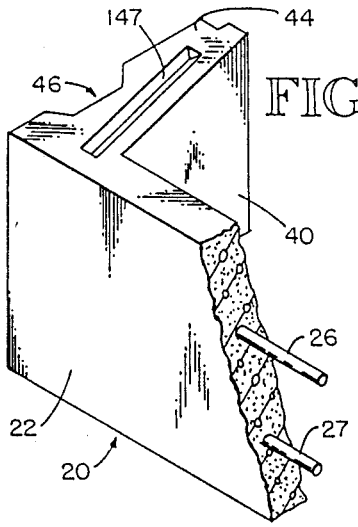
FIG. 15
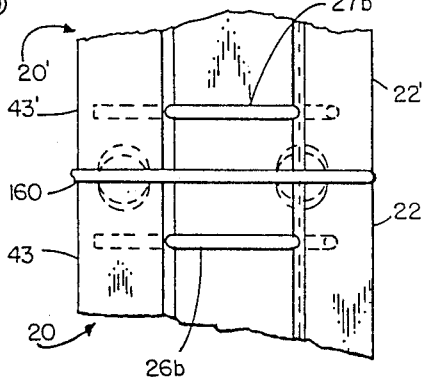
FIG. 16
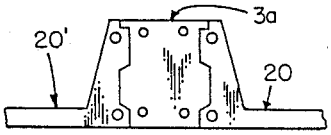
FIG. 18A
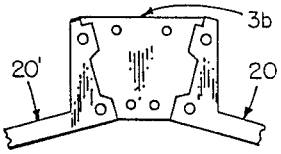
FIG. 18B
FIG. 17
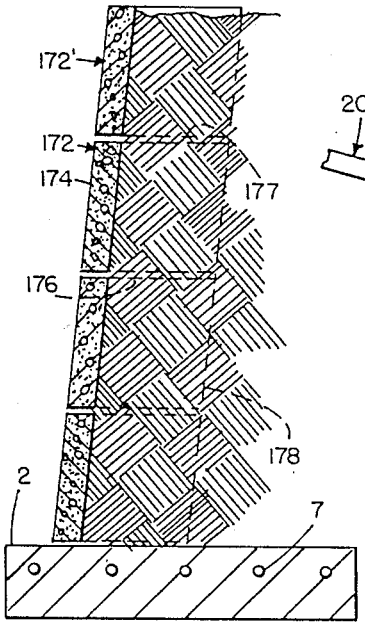
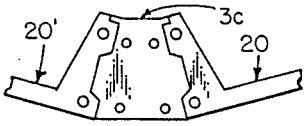
FIG. 18C
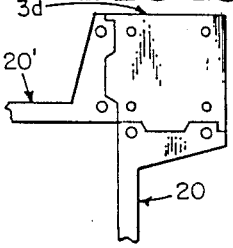
FIG. 18D
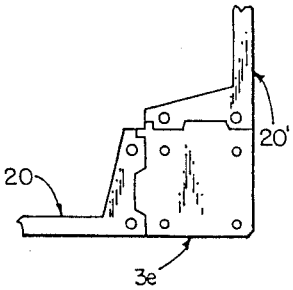
FIG. 18E

PRE-CAST, REINFORCED CONCRETE RETAINING WALL SYSTEM

TECHNICAL FIELD

This invention relates to retaining walls and in particular, to pre-cast, reinforced concrete modular retaining wall systems. More particularly this invention relates to a retaining wall system that uses a pre-cast, reinforced concrete retaining wall module.

BACKGROUND INFORMATION

Many systems have been developed for protecting and physically supporting different soil elevations. A rockery, for instance, uses large size rocks which interlock and lean against an earth slope to protect the slope from slides due to weather erosion. Unfortunately, rockeries provide little or no structural support for the retained soil and are not self-supporting. They require reasonably stable native soil and are ineffective for supporting fine, sand-like soil or water.

In the past, different methods have been used to construct earth retaining walls. Many systems use large manufactured block-type units that interlock or key together and rely on dead weight to function.

McLean, (U.S. Pat. No. 250,235), discloses the use of a prefabricated interlocking rectangular glass block having a full length groove and full length rib stacked one upon the other to build a glass retaining wall to hold back see water.

Schmidt, (U.S. Patent No. 2,313,363), describes a prefabricated retaining wall using blocks made from undisclosed material which are laid one on top of another in staggering superimposed rows so that each block has a longitudinal tongue on its bottom surface which overlaps the inside top edge of the lower block.

Meheen, et al., (U.S. Pat. No. 4,050,254), discloses a prefabricated module retaining wall using a plurality of pre-cast tie-back elements attached to curve panels. Each tie-back consists of a horizontal leg which is buried in the retained soil and exposed vertical legs. The curved panels attach to the vertical legs and act to retain the soil.

Sheehan, (U.S. Pat. No. 4,067,166), discloses the construction of a retaining wall using interlocking tongue and groove boxes having an elongated reinforced support bar buried in the soil.

In the related building construction art, Wolfe, (U.S. Pat. No. 2,160,773), discloses the use of interlocking concrete slabs having a plane outer side and a traversely curved inner side. The slabs have reinforcing wires with looped ends which extended through rabbeted ends on each slab. These ends are abutted and the loop ends are then placed around vertical steel bars which hold the slab in place.

Another group of earth supporting systems seen in the prior art use elements placed horizontally into the retained earth. These elements may be rigid or consist of a mat-like structure made of pencil strands which are laid horizontally and covered with compacted earth. Both the rigid members and the mats are structurally attached to a pre-cast concrete interlocking pattern of wall units to form the system. In order to construct this type of wall system, a large horizontal area, adjacent to the wall is required. Since such areas are not always available, these systems can not be used in many situations.

The basic structure of a concrete retaining wall includes a footing of varying size and a relatively narrow vertical concrete wall attached to it. Structural reinforcing the rods are placed in such a manner that, in combination, the wall and the footing operate as a single unit. Using this type of retaining wall, a structural engineer can predictably and safely design a retaining wall to combat the forces found in the specific field conditions.

None of the prior art, however, discloses retaining wall systems using pre-cast, reinforced concrete modules combined with cast-in-place structural elements as disclosed herein.

DISCLOSURE OF INVENTION

It is the general object of the present invention to provide an improved pre-cast reinforced retaining wall system which will retain both soil and water.

It is an object of the invention to provide a versatile retaining wall module that can be easily adapted to different types of soils and conditions by the flexible arrangement of like modules.

It is an object of the invention to provide a low cost, easily fabricated, structurally engineered retaining wall system that can be built on site using modules that can be easily transported.

It is an object of the invention to provide a retaining wall module which can be made in various sizes which can be easily handled manually or with light construction machinery.

It is an object of the invention to provide a retaining wall system that allows for curved walls and inside or outside corners using a single, pre-cast, reinforced concrete module.

It is a further object of the invention to provide a retaining wall that can be structurally attached to a preconstructed foundation footing.

It is a further object of the invention to provide a retaining wall that operates in a structurally engineered manner that requires very little excavation or alteration of surrounding soil.

It is a still further object of the invention to provide a retaining wall system with an exposed front surface which can be easily manufactured in different styles and appearances.

The present invention is a pre-cast, reinforced concrete module that can be used with a plurality of like modules which interconnect with vertical concrete columns to build a structurally engineered retaining wall. Disclosed herein are various embodiments of a module, a novel retaining wall structure, and methods for building a retaining wall structure.

In the preferred embodiment, the module is channel-shaped having a central panel with integrally attached flanges at each first and second opposite end. The central panel has parallel front and rear surfaces and parallel top and bottom surfaces. Each flange extends rearwardly, substantially perpendicularly to the panel's outside and inside surfaces. Each module has one or more horizontal reinforcing rods. Each rod has a first end section which extends through the first flange then across the panel and through the second flange, terminating at the rear portion thereof. On the outside surface of each flange is a vertical recess across which a portion of each of the horizontal reinforcing rods is exposed. These exposed portions are later surrounded by concrete in a cast-in-place vertical reinforced column constructed between each module.

When constructing the retaining wall structure, a horizontal row of modules is placed on the top surface of a suitable reinforced footing. Each module can be lifted at each end at the exposed portions of the horizontal reinforcing rods and positioned adjacent to another module with its front surface positioned vertically. Each flange is positioned opposite to a flange located on an adjacent module with a vertical column space created in between.

Once the first row of modules are positioned, identical modules are then stacked above and aligned. Located on the top and bottom surface of each flange is an alignment means used to vertically align and, when necessary, horizontally separate stacked modules. The alignment means may comprise a pair of half-spherical or a single, V-shaped recess located on the top and bottom surface of each flange. Later, during wall assembly, complimentary spherical or elongated rectangular alignment elements are placed in the recesses to align and to vertically separate stacked modules. By using alignment elements having different cross-sectional dimensions, the space between stacked modules may be adjusted to allow for drainage of soils where necessary.

Once the modules are stacked to the desired height, reinforced vertical columns are then constructed in the column spaces located between adjacent modules by appropriate placement of concrete and steel reinforcement. Between adjacent modules, a rear column form is placed to extend between the opposite flanges and a front column form extends between the opposite front surfaces. The rear column form may be held in place by attaching a vertical edge of the form to a rear form attachment means located on either the distal or outside surface of each opposite flange. A rear form attachment means comprises either a vertical rabbet located between the distal and outer surfaces of each flange or a vertical slot located on the outside surface of each flange. The rear column form itself may be either planar for smaller columns or channel-shaped extending rearwardly to construct a larger column.

The front column form is usually planar and placed in front of each column space by attaching the vertical edges of each form to the front surface of each adjacent module, using a front form connecting means, such as a tie rod connector. In some instances, one tie rod connector may be positioned horizontally between stacked modules along the top surface of each flange. The ends of the connector extend beyond the distal and front surfaces of the module and serve as the attachment means for the rear and front column forms.

When the front and rear column forms are attached, concrete is then placed into each vertical column space to construct the vertical columns. The wet concrete is placed into the recesses located on the outside surfaces of each opposite flange and surrounds the exposed portions of the horizontal reinforcing rods spanning the recesses. In this manner, each module is interlocked with adjacent, superjacent and subjacent modules. Once the concrete in the column space has cured, the front and rear column forms are removed and construction of the vertical reinforced concrete column is completed. Once all of the vertical columns are constructed, all of the modules are interlocked with adjacent, superjacent, and subjacent modules creating a structurally engineered retaining wall structure. Exposed tie rod segments may be broken off as desired.

In another embodiment, a module is provided having a similar channel-shaped structure with front panel extensions projecting laterally from each opposite end of the panel, substantially perpendicular to the outside surface of each flange. The outer vertical surface of each extension has an outer edge alignment means which engages with the panel extension located on adjacent module.

As described above, during the retaining wall assembly, a horizontal row of modules is placed on a suitable reinforced footing. Each module is positioned adjacent to another module with its front surface visible and positioned vertically and with each flange positioned opposite the flange located on an adjacent module. Between each module is a vertical column space defined on two sides by the two opposite flanges and along a front surface by the two converging opposite front panel extensions.

The outer edge alignment means located on each panel extension may include a vertical slot located on the outside surface of each front panel extension. During wall assembly, complimentary modules are positioned adjacent to one another and the edges of a front flexible form made of vinyl or some other suitable material and inserted into the opposites extending the form between adjacent modules.

Alternatively, the outer edge alignment means may include a complimentary convex or concave surface located along the vertical outer edges of each panel extension which, during wall assembly, engages with complimentary convex and concave surfaces located on adjacent modules.

In still another embodiment, the module comprises a panel having two opposite, vertical end surfaces and at least one horizontal reinforcing rod. Each rod has a central portion which transverses the panel and two exposed opposite end sections which extend rearwardly from the panel s rear surface near each opposite vertical end surface. Each panel also has a wide front and rear surface, and a narrow top and bottom surface. A rear surface attachment means, such as a bolt insert which can be attached to a bolt, is located on the rear surface of each panel. An end surface alignment means is located along each vertical end surface which aligns the front surface of each panel with the adjacent panel during wall assembly.

The end alignment means used with this embodiment may be similar to the outer edge alignment means disclosed in the second embodiment. The end alignment means may include a centrally located vertical slot located on each vertical end surface which accepts one edge of a front flexible form. When the panels are properly positioned, a front flexible form is interposed between two adjacent panels by inserting the form into the vertical slots located on the adjacent panels. The outside and inside edges of each vertical end surface may be beveled inwardly to ensure proper alignment.

Alternatively, the end surface alignment means may include a complimentary concave or convex surface located on the vertical end surfaces of each panel. When a panel is positioned adjacent to another panel, the concave vertical end engages with the convex vertical end surface located on the adjacent panel to interconnect and align the panels. The concave and convex vertical surfaces key together to properly align the adjacent panels.

Using the third embodiment to construct a retaining wall, a horizontal row of panels is first placed on a reinforced footing with panels having a complimentary end alignment means being positioned next to one another. A reusable vertical steel column form having three closed sides and an open front side is attached to and bridges the joint between adjacent panels. A vertical edge of the steel form attaches to the rear surface attachment means located on the rear surface of each adjacent panel thereby creating a closed column space therein.

During manufacture of each panel, the horizontal reinforcing rods are bent inwardly and parallel to the inside surface of each panel. When the steel column forms are attached, the rods are bent perpendicular to the rear surface and extended into the column space created by the form.

Once the first row of modules are positioned on the footing, successive rows of panels are then stacked above and attached to the steel forms until the desired wall height is achieved. Wet concrete is then placed into the column space inside each steel form surrounding the exposed portions of each horizontal rod and interlocking the adjacent, superjacent, and subjacent modules. Once the concrete in the columns has cured, the steel forms are removed and the retaining wall structure is completed.

With each embodiment, the front surface of each module may be sloped so that slope or batter may be produced in the retaining wall structure for aesthetic or structural reasons. With this modification, the front surface of the central panel is acutely angled with respect to the bottom surface of each flange. In this manner, the front surface of each module slopes rearwardly into the embankment while the top and bottom surfaces of each module is horizontal and parallel with the top and bottom surfaces on the upper and lower modules.

Other features and advantages of the present invention will be brought out in the following more detailed description of a specific embodiment made in conjunction with the accompanying drawings.

BRIEF DESCRIPTION OF THE DRAWINGS

FIG. 2 is a perspective view partially broken away of the first and preferred embodiment of a pre-cast, reinforced concrete module with a segment of an adjacently placed module.

FIG. 3 is a bottom, plan view of the preferred embodiment shown in FIG. 3.

FIG. 4 is a partial plan view of a portion of two adjacent modules having complimentary vertical slots located on the outside surface of each flange with a rear column form inserted therein.

FIG. 5 is a partial plan view of two adjacent modules having an attached extended column form used to construct a larger rearwardly extending column.

FIG. 6 is a partial plan view of another embodiment of this invention showing two adjacent modules having an attached rear column form and a pair of front panel extensions with vertical slots located on each vertical end surface with a front flexible form inserted therein.

FIG. 7 is a partial, sectional, elevation view of the embodiment shown in FIG. 6.

FIG. 8 is a partial plan view of two adjacent modules having opposite front panel extensions with compatible concave and convex vertical end surfaces.

FIG. 9 is a vertical cross sectional view of the retaining wall taken along lines 9—9 in FIG. 1.

FIG. 10 is a vertical cross-sectional view of the retaining wall, taken along lines 10—10 in FIG. 1.

FIG. 11 is a perspective view of still another embodiment of this invention comprising a panel having rearwardly extending horizontal rods.

FIG. 12 is a partial plan view of two adjacent modules shown in FIG. 11 wherein adjacent modules are attached to a rear steel column form with a front flexible form inserted between opposite vertical end surfaces.

FIG. 13 is a partial vertical cross section, taken along lines 13—13 shown in FIG. 1 showing two stacking modules aligned by a spherical alignment element located in a half-spherical recess between stacked top and bottom flange surfaces.

FIG. 14(*a*) is a partial vertical cross section view taken along lines 14—14 shown in FIG. 1 showing two stacking modules aligned by an elongated square alignment element positioned on edge in V-shaped recesses located on the top and bottom flange surfaces.

FIG. 14(*b*) is a partial vertical cross section view similar to the view taken in FIG. 14(*a*) showing the use of a smaller elongated square alignment element positioned on edge and located in a V-shaped recess creating a narrower space between stacked modules.

FIG. 15 is a partial perspective view of the alternative V-shaped alignment recess located on the top surface of a module flange as shown in FIGS. 14(*a*) and 14(*b*).

FIG. 16 is a partial vertical cross section view taken along lines 16—16 in FIG. 1 showing a suitable sealant between stacked modules.

FIG. 17 is a cross-sectional view of a retaining wall with a batter using modules having horizontal top and bottom flange surfaces and acutely angled panel front surfaces with respect to the bottom flange surface.

FIG. 18(*a*) is a partial plan view of the vertical column used to make a straight wall section using the first embodiment of the pre-cast, reinforced module.

FIG. 18(*b*) is a partial plan view of the vertical column used to make an inside turn on the retaining wall using the first embodiment of the pre-cast reinforced module.

FIG. 18(*c*) is a partial plan view of the vertical column used to make an outside turn on the retaining wall using the first embodiment of the pre-cast reinforced module.

FIG. 18(*d*) is a partial plan view of the vertical column used to make an inside corner in a retaining wall section using the first embodiment of the pre-cast reinforced module.

FIG. 18(*e*) is a partial plan view of the vertical column used to make an outside corner in a retaining wall section using the first embodiment of the pre-cast reinforced module.

BEST MODE FOR CARRYING OUT THE INVENTION

Figure 1:
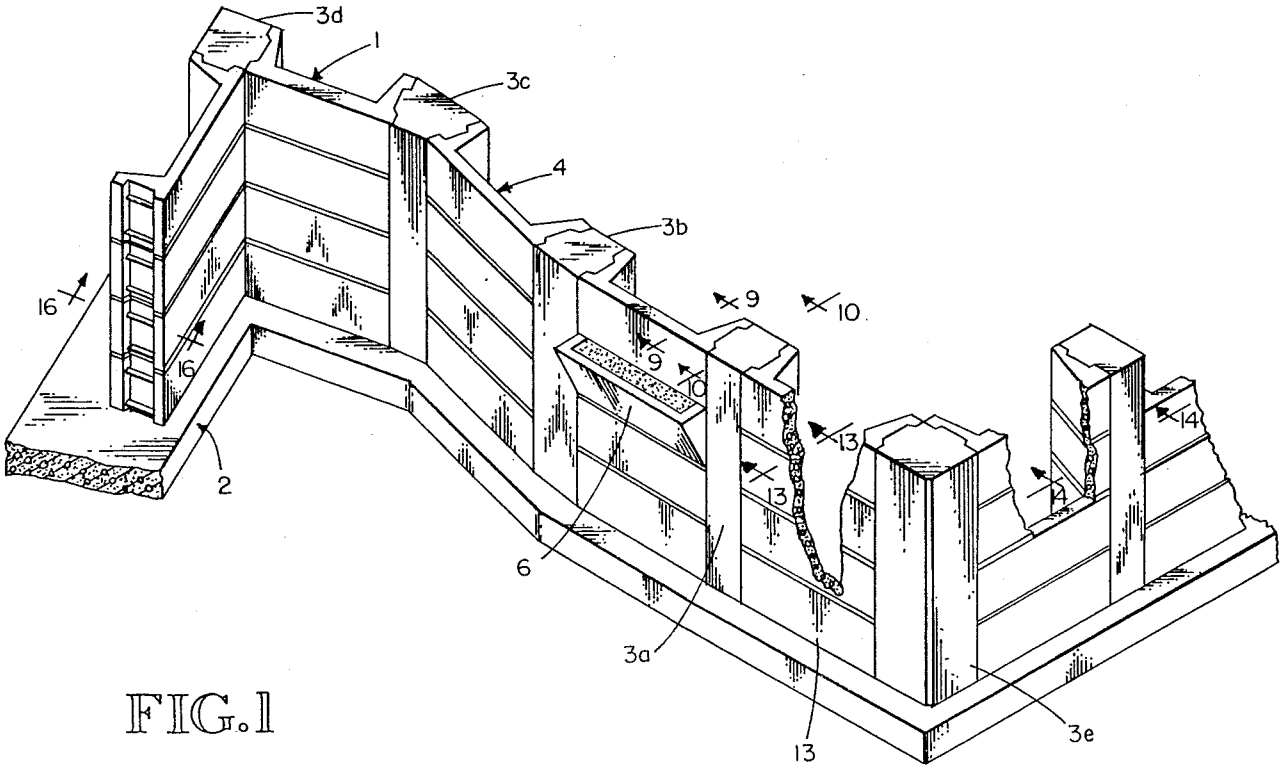
FIG. 1 is a perspective view of a portion of the structurally engineered retaining wall disclosed herein.

The present invention is a structurally engineered, reinforced retaining wall system that uses a single, precast, reinforced concrete module combined with cast-in-place vertical columns The primary purpose of this system is to retain soil or water where horizontal space is limited and where rockeries and other structurally poured concrete walls might be used.

Referring specifically to the drawings wherein like numerals indicate like parts there is seen a retaining wall 1, shown in FIG. 1, comprised of a pre-poured, reinforced, continuous footing 2, on-site constructed vertical columns 3*a*, 3*b*, 3*c*, 3*d*, 3*e*, and horizontally positioned, stacked modules 4. Various module embodiments are disclosed in this invention. Each module is easy to fabricate and transport and easy to handle during retaining wall construction.

The first embodiment 20, shown in FIGS. 2 an 3, is channel-shaped, having a central panel 21 with a pair of integrally attached flanges 30 and 40 at opposite ends. Each central panel 21 has parallel front 22 and rear 23 vertical surfaces and parallel top 24 and bottom 25 horizontal surfaces which are substantially perpendicular to the front 22 and rear 23 surfaces.

Right flange 30, attached at one end of central panel 21, has parallel top 34 and bottom 35 horizontal surfaces, a vertical distal surface 33 parallel to front surface 22, and an outside 31 and inside 32 surface. Located centrally on outside surface 31 is vertical recess 36.

Left flange 40, attached at the opposite end of panel 21, has parallel top 44 and bottom 45 surfaces, a vertical distal surface 43 parallel to front surface 22, and an outside 41 and inside 42 surface. Located centrally on outside surface 41 is vertical recess 46.

Outside surfaces 31 and 41 are parallel with each other end substantially perpendicular to front surface 22 of panel 21. As more clearly shown in FIG. 3, inside surfaces 32 and 42 are obtusely angled with respect to rear surface 23.

As shown in FIGS. 2 and 3, traversing each module 20 is a pair of horizontal reinforcing rods 26 (top), 27 (bottom), each commencing in flange 30, extending across panel 21, and ending in flange 40. Portions 26(*a*) and 26(*b*) of rod 26 are exposed at recesses 36 and 46, respectively, and portions 27(*a*) and 27(*b*) of rod 27 are exposed at recesses 36 and 46, respectively. Later, portions 26(*a*),(*b*) and 27(*a*),(*b*) are surrounded by concrete during the construction of the vertical column 3 located between adjacent modules 20, 20'.

As shown in FIGS. 2, 3, 4, and 5, right flange 30 and left flange 40 each have a rear column form attachment means which attaches to rear column form 57. In the preferred embodiment, as shown in FIGS. 2 and 3, the rear column form attachment means located on right flange 30 comprises a vertical rabbet 37 extending from the bottom surface 35 to the top surface 34 located between distal surface 33 and outside surface 31. On left flange 40, the rear form attachment means comprises a vertical rabbet 47 extending from the bottom surface 45 to the top surface 44 located between distal surface 43 and outside surface 41. A connector means, such as a tie rod connector 56 may be positioned along the top surfaces of each flange 30, 40 to hold the edges of form 57 within each rabbet.

As shown in FIG. 4, an alternative rear column form attachment means comprises vertical slots 38, 48 located on the outside surfaces of each flange. Slot 38 (shown on the adjacent module) which extends from the bottom surface 35 to the top surface 34 is located on outside surface 31 of right flange 30. Slot 48 which extends from the bottom surface 45 to the top surface 44 is located on outside surface 41 of left flange 40. During retaining wall 1 assembly, the vertical edges of form 57 are inserted into each opposite slot 38', 48 to define the rear surface of the vertical column 3.

As shown in FIG. 5, the distal surface 33, 43 of each flange may be flat with a connecting means, such as tie rod connector 56 used to hold one edge of a straight 57 or extended 58 rear column form against each surface.

Located on the top 34 and bottom 35 surfaces of right flange 30 and on top 44 and bottom 45 surface of left flange 40 is an alignment means used to align and vertically separate superjacent and subjacent modules. As shown in FIGS. 2, 4, 13, in the preferred embodiment 20 the alignment means includes a pair of half-spherical recesses 50(*a*) and 50(*b*) located on top surface 34. Located on the bottom surface 35 of right flange 30 is a pair of half-spherical recesses 51(*a*) and 51(*b*). On left flange 40, a pair of half spherical recesses 52(*a*) and 52(*b*) are located on top surface 44 and a pair of half-spherical recesses 53(*a*) and 53(*b*) on bottom surface 45. During the manufacture of module 20, recesses 50(*a*), 50(*b*) and 52(*a*), 52(*b*) are aligned with recesses 51(*a*), 51(*b*) and 53(*a*), 53(*b*) so that the front surfaces, 22, 22' are vertically aligned when the modules 20, 20' are stacked.

Later, during retaining wall 1 assembly, a spherical alignment element 54 is placed in each top surface alignment recess 50(*a*), 50(*b*), 52(*a*) and 52(*b*). When positioned in each recess, the upper portion of each element 54 extends above the top surfaces of each flange. As more clearly shown in FIG. 13, when the modules 20, 20, are stacked, the upwardly extending portions of each element 54 engage with the recesses 51(*a*)', 51(*b*)', 53(*a*)', and 53(*b*)' located on the bottom flange surfaces of the stacked module 20'. By properly engaging the elements on the lower module with the recesses located on the bottom flange surfaces 35, 45 of the above module, the modules are thereby aligned.

An alternative alignment means, shown in FIGS. 14(*a*), 14(*b*) and 15, operates similarly to the above described means includes an elongated, V-shaped, horizontal recess 142, 144 located on top surface 34, 44, of each flange 30, 40, respectively. Complimentary recesses 143, 145 (not shown) are located on the bottom flange surfaces 35, 45 of each flange 30, 40, respectively, that are vertical aligned with the top recesses 142, 144. Each recess 142, 143, 144, 145 is positioned horizontally, oriented inwardly, and angled obtusely with respect to the rear surface 23. During retaining wall 1 assembly, a complimentary elongated square alignment element 148 is placed inside each top recess 142, 144. Like the spherical elements, the upper portion of each element 148 extends above the top surface of each flange and engages with the bottom recesses 143, 145 to align the stacked modules 20, 20'.

Both the spherical elements 54 and square elements 148 may be made of wood or other suitable materials.

In the second embodiment of this invention, shown in FIGS. 6, 7, and 8, module 60 is similar to module 20 having a channel shaped with a central panel 61 and a pair of integrally attached flanges 70, 80 at opposite ends. Each module 60 has a pair of horizontal reinforcing rods 66, 67 commencing in flange 70, extending across panel 61, and terminating in flange 80. On the outside surface 71 of the right flange 70 is a vertical recess 76 across which portions 66(*a*) and 67(*a*) of rods 66 and 67 are exposed. On the outside surface 81 of the left flange 80 is a vertical recess 86 across which portions 66(*b*) and 67(*b*) of rods 66 and 67 are exposed.

At each opposite end of the central panel is a laterally projecting front panel extension 90, 95. Both extensions 90, 95 are oriented in the same plane as front surface 62 and are substantially perpendicular to outside surfaces 71 81 of the adjacent flange 70, 80.

Located on the outside vertical surface of each extension, is an outer edge alignment means which aligns the front surface of the module 60 with each adjacent module. As shown in FIGS. 6 and 7, the outer edge alignment means includes a vertical slot 78, 88 located on the outside vertical surface of each extension 90, 95. During retaining wall assembly, the extensions 90, 95 located on adjacent modules converge with slot 78 positioned opposite to slot 88'. A front flexible form 93 is inserted in the opposite slots 78, 88' to align the adjacent modules 60, 60'. The outside vertical edges of each extension 90, 95, may be beveled to allow for further adjustment.

Alternatively, as shown in FIG. 8, the outer edge alignment means may include complimentary concave 92 and convex 97 vertical surfaces located on the opposite outside end surfaces of each extension 90, 95. During retaining wall assembly, adjacent modules 60, 60' are properly aligned by engaging a concave surface 92' with the convex surface 97 located on the adjacent module 60. By using complimentary concave and convex vertical surfaces, the modules can be easily adjusted and aligned, and a front flexible form 93 is not required.

As described in the first embodiment 20, a rear form attachment means is located on or near the distal surfaces 73, 83 of each flange 70, 80. As shown in FIG. 6, the rear form attachment means may include a vertical rabbet 77, 87' located on each opposite flange 70, 80'. On the first flange 70 is a vertical rabbet 77 located between the outside surface 71 and the distal surface 73. On the second flange 80 is a vertical rabbet 87 located between the outside surface 81 and the distal surface 83. As shown in the first embodiment 20 in FIG. 2, a connector means, such as a tie rod connector 56, may be used to hold the edges of the rear form 57 in each rabbet.

Also as shown in FIG. 4 with the first embodiment, the rear form attachment means on the second embodiment 60 (not shown) may also include a vertical slot located on the outside surfaces 71, 81 of each flange 70, 80, respectively. A connecting means, such as a tie rod connector 56, may be used to hold a rear form 57 inside each slot.

Also, as shown on the first embodiment 20 in FIG. 5, the distal surfaces 73, 83 of each flange 70, 80 on module 60 may be flat and a connector means, such as tie rod connector 56, may be used to hold the rear column form directly against each distal surface.

Located on the top surfaces 74, 84 of the flanges 70, 80 are alignment means similar to the alignment means disclosed in the first module embodiment 20. As shown in FIGS. 6 and 7, a pair of half-spherical recesses **79(*a*) and 79(*b*) are located on top flange surface 74 and a pair of half-spherical recesses 163(*a*) and 163(*b*) are located on bottom flange surface 75. A pair of half-spherical recesses 89(*a*) and 89(*b*) are located on top flange surface 84 and a pair of half-spherical recesses 164(*a*) and 164(*b*) are located on bottom flange surface 85. A spherical alignment element 54 is place in each recess 79(*a*), 79(*b*), 89(*a*), 89(*b*) which engages with the recesses 163(*a*)', 163(*b*)', 164(*a*)', and 164(*b*)' located on the bottom flange surfaces 75', 85' to align the stacked modules 60, 60'**.

A single, elongated, V-shaped recess 147 (not shown) located on the top and bottom surfaces of each flange may be used with the second embodiment 60 to align the stacked modules. During retaining wall assembly, a rectangular element 148 (not shown) is placed inside each top recess. The upper portion of element 148 extends above the top flange surface and engages with the recesses located on the bottom flange surface of the above stacked module 60'.

As seen in FIGS. 1, 2, 6, and 9 central panels 21 and 61 respectively of each module 20, 60 may be modified by extending forwardly to make a planter structure 6.

Except as otherwise stated, a retaining wall structure 1 can be constructed in a similar manner using either first 20 or second embodiment 60. The first steps in constructing retaining wall 1 is the excavation of soil 99 and the construction of a reinforced concrete footing 2 at the desired location. As seen in FIGS. 9 and 10, footing 2 may have horizontal reinforcing rods 7 which extend along the footing's 2 length. Vertical reinforcing rods 8 are placed in the footing 2 and extended upwardly therefrom at predetermined column 3 locations. Later, when the columns 3 are constructed, the upwardly extending portions of rods 8 are surrounded with concrete and interconnect footing 2 with each vertical column 3.

Once footing 2 is constructed, a horizontal row of modules is positioned along the footing's 2 upper horizontal surface 12. The modules 20 are lifted onto surface 12 either manually or with light construction machinery by lifting each module at the exposed portions **26(*a*), 27(*a*), and 26(*b*), 27(*b*) of the horizontal reinforcing bars 26, 27 located in recesses 26 and 46. Each module 20 is positioned between the extending portions of vertical reinforcing rods 8 adjacent to another module 20'. Between the opposite flanges 30, 40 is a column space 180 or 200 through which the exposed portions of rods 8** extend.

Once the first horizontal row of modules is completed, spherical alignment elements 54 made of wood or other suitable materials, are then placed into the half-spherical recesses **50(*a*), 50(*b*) located on top surface 34 of flange 30 and into the half-spherical recesses 52(*a*), 52(*b*) located on top surface 44 of flange 40. A second module 20' is then stacked and aligned above a lower module 20 by the engaging elements with half-spherical recesses 51(*a*)', 51(*b*)' and 53(*a*)', 57(*b*)' located on the bottom flange surfaces 35' and 45' located on the stacked module. Once completed, successive rows of modules 20** are then stacked and aligned until the desired wall height is obtained.

As seen in FIG. 6, when using the second embodiment 60, the front surfaces 22, 22' of adjacent modules 60, 60' are aligned by inserting a front flexible form 93 in the opposite slots 78, 88 located on adjacent front extensions 90', 95.

Once the modules are stacked to the desired height, reinforced vertical columns 3 are then constructed inside the column space 180 created between the adjacent modules. When necessary, vertical reinforcement rods 126 and horizontal rods 127 may be placed in each vertical column space 180 to provide additional strength and support. As seen in FIG. 5, an extended rear form 58 may be used to create a larger column space 200.

As shown in FIG. 2, rear form 57 is inserted in the opposite vertical slots 37', 47 located on the opposite flanges 30', 40 of adjacent modules 20', 20. As seen in FIG. 5, an extended rear column form 58 may be used in place of form 57 to construct a larger column.

As shown in FIG. 5, front column form 59 is attached in front of each column space 180 with a front form attachment means. In one embodiment, the vertical edges of form 59 are attached to the front surfaces 22, 22' of each adjacent module 20, 20' using tie rod connectors 56 at each corner. Each tie rod connector 56 is positioned horizontally between the top flange surfaces 24, 34 and the bottom flange surfaces 25, 35. As seen in FIG. 2, a bore may be made in each spherical alignment element 55 through which the tie rod connector 56 may transverse.

Once all of the vertical rear column forms 57 and front column forms 59 are attached, concrete is then poured into the column space 180 to construct the reinforced column 3. When the concrete is so poured, portions of the incoming and downwardly flowing concrete enters recesses 36 and 46 located on the opposite flanges 30, 40 and surrounds the exposed portions 26(*a*), 26(*b*) and 27(*a*), 27(*b*) of reinforcing steel rods 26 and 27 and the added vertical 126 and horizontal 127 reinforcing rods. Once the concrete in each vertical column has cured, the rear 57 and front 59 forms are removed and construction of the vertical concrete column 3 is completed. Once all of the modules are positioned and aligned and the columns 3 are constructed, the retaining wall 1 is completed and the soil 99 surrounding wall 1 can be moved to the desired location.

As seen in FIG. 17, retaining wall 1 may be modified to have a batter by manufacturing the front surface 174 of each module at an acute angle with respect to the bottom panel surface 176 and top 177 and bottom 176 flange surfaces. The distal surface 178 of each flange may be manufactured parallel with the front surface 174. With this modification, module 172 are stacked in the same manner as described above with the top 177 and bottom 176 flanges surfaces being positioned horizontal and parallel with the top and bottom flange surfaces located on the upper or lower modules. By properly aligning stacked modules 172, 172', a batter is created in the retaining wall structure.

As seen in FIGS. 14(*a*), 14(*b*), by interchanging smaller rectangular element 149 with larger rectangular element 148, the space 150 between stacked modules 20, 20' may be adjusted to allow for or to prevent fluid drainage from the soil. During wall construction, the worker can adjust the space between the stacked modules by cutting two adjacent edges of the larger element 148 to reduce its cross-sectional dimension. For this reason, modules having V-shaped alignment recess may be better suited than modules having half-spherical recesses when fluid drainage may be required.

Alternatively, as shown in FIG. 16, cement 160 or some other suitable material may be used between stacked modules 20, 20' to prevent fluid drainage from the soil.

In FIGS. 11 and 12, a third embodiment of this invention is shown. Module 110 consists of a flat panel 111 having parallel front 112 and rear 113 surfaces and parallel top 114 and bottom 115 surfaces. A pair of horizontal reinforcing rods 116, 117 traverses panel 111 and extends rearwardly from rear surface 113 exposing portions 116(*a*) and 116(*b*) of rod 116 and portions 117(*a*) and 117(*b*) of rod 117. A pair of expansion bolt inserts 120(*a*) and 120(*b*) are located centrally on the rear surface 113.

On each vertical end surface of panel 111 are end surface alignment means which are used to align adjacent modules. In one embodiment, the end alignment means includes vertical slots 130, 135 located at opposite end surfaces in which a front flexible form 89 may be inserted. During the manufacturing of panel 111, portions 116(*a*) and 116(*b*) of rod 116 and portions 117(*a*) and 117(*b*) at rod 117 are bent inward parallel to the rear surface 113. Alternatively, complimentary concave and convex vertical surfaces may be manufactured along each vertical end surface to align adjacent modules similar to the complimentary concave 92 and convex 97 vertical surfaces described in the second embodiment seen in FIG. 8.

The first step in constructing a retaining wall with module 110, is the construction of a reinforced concrete footing 2 having vertical extending reinforcement rods at predetermined column locations. Once the footing is completed, a horizontal row of modules 110 is positioned on top surface 112 between the column locations. A reusable, vertical steel form 125 is attached between adjacent modules 110 and 110' at each column location with bolts 121(*a*) and 121(*b*) which connect to bolt inserts 120(*a*) and 120(*b*) located on the rear surface of each adjacent module 110. As seen in FIG. 12, exposed portions 116(*a*)' and 116(*b*) of rod 116 and portions 117(*a*)' and 117(*b*) of rod 117 attached to the adjacent module are bent reasonably perpendicular to the rear surface 113 and extended into column space 140. A front flexible form 93 is then inserted in opposite slots 130' and 135 located on adjacent modules 110', 110.

After each row of modules is properly positioned and aligned, successive rows of modules are aligned above and attached to steel form 125. Once all of modules 110 are aligned and attached to steel form 125, vertical 126 and horizontal 127 rods are added to each column space 140 when necessary. Concrete is then poured into the column space 140 surrounding rods 116 and 117 and the vertical 126 and horizontal 127 rods to construct the column. After columns have cured, steel forms 125 are removed and can be used again.

As shown in FIG. 18(*a*)–(*e*), the path of the retaining wall 1 can be changed and different vertical columns can be constructed by changing the relative positions of the adjacent modules. In this manner, the dimensions of the columns rear and front column surface dimensions can be varied to create either straight 18(*a*), inside 18(*b*), or outside 18(*c*) wall sections and inside 18(*d*) or outside 18(*e*) turns.

The precasting of the herein disclosed modules, depending on various factors, such as their size, the location and size of the job site, the location of concrete mixing plants, the availability of concrete delivery trucks, the availability of access roads, the availability of concrete pumping equipment, and/or the availability of good weather will determine whether the modules will be made at the job site, at the concrete factory site, and/or another selected site.

Each module can be manufactured in various sizes. The selected size will depend on many factors. They may be sized to be handled by two men. However, they preferably will be sized to be handled by comparatively small-sized construction machinery.

In compliance with the statute, the invention has been described in language more or less specific as to its features. It is to be understood, however, that the language is not limited to the specific features shown, since the means and composition disclosed comprises preferred forms of putting the invention into effect. The invention is, therefore, claimed in any of its forms or modifications within the legitimate and valid scope of the appended claims, appropriately interpreted in accordance with the doctrine of equivalence.

INDUSTRIAL APPLICABILITY

Pre-cast, reinforced retaining wall modules will find wide spread use in every industry where there exists a need for a retaining wall structure to retain soil or water. The modules and retaining wall system described herein will be especially useful in the building and road construction and landscaping industries.

I claim:

1. A retaining wall module, comprising:
(a) a vertically disposed panel;
(b) a pair of vertically disposed flanges, said flanges horizontally disposed at opposite ends of said panel and projecting rearwardly therefrom, said flanges each having a vertically disposed outside recess, said recess being horizontally transversed by at least one exposed rod embedded in said flanges on each side of said recess.

2. A retaining wall module as recited in claim 1, further comprising a vertical recess located on the rearward end of each said flange.

3. A retaining wall module as recited in claim 2, wherein said vertical recess comprises a vertical slot located on an outside surface of each said flange.

4. A retaining wall module as recited in claim 1, wherein said module is made of concrete.

5. A retaining wall module as recited in claim 1, further comprising:
(a) at least one pair of complimentary and aligned first and second elongated V-shaped slots, said first V-shaped slot located on a top surface of a flange of a lower of two stacked modules, and said second V-shaped slot located on a bottom surface of a flange of an upper of two stacked modules; and,
(b) an elongated square cross-sectional body of such cross sectional size that when positioned in said first slot, an upper portion of said square body extends above said top surface to engage said second slot when said modules are stacked, thereby aligning said modules.

6. A retaining wall module as recited in claim 5, wherein said elongated square body is made of wood.

7. The apparatus of claim 5 wherein said elongated square body is of sufficient cross sectional size that when said modules are stacked, they are separated vertically from each other by said square body.

8. A retaining wall module as recited in claim 1, further comprising, on opposite outer vertical edges of said panel, a panel edge alignment means.

9. A retaining wall module as recited in claim 8, wherein said panel edge alignment means comprises a vertical slot located on each said outer vertical panel edge.

10. A retaining wall module as recited in claim 8, wherein said panel edge alignment means comprises a vertical concave edge and a vertical convex edge.

11. A retaining wall system comprising:
(a) a footing having a spaced apart plurality of groups of vertical column reinforcing rods, each group having at least one rod, said rods projecting upwardly from said footing,
(b) a plurality of stacks of precast modules vertically stacked between successively spaced groups of said rods, each said module having a pair of rearwardly projecting flanges, each said flange having a vertical outside surface with a vertical recess, said recess transversed by at least one exposed rod embedded in each side of said recess whereby opposing outside surfaces of said flanges on adjacent stacks define two vertical column surfaces; and
(c) at least one cast-in-place vertical column between successive stacks of modules, each said column interlocking with said transverse rods in said recesses and with said vertical column rods.

12. The retaining wall system of claim 11 wherein the number of vertical column reinforcing rods in each said group is a plurality.

13. The retaining wall system of claim 11 wherein each of said groups of said vertical column reinforcing rod are so disposed to project upwardly from said footing, and each of said plurality of stacks of precast modules are so disposed upon said footing, that said groups of vertical column reinforcing rods are positioned in each said vertical column relatively rearwardly in said column.

14. The retaining wall system of claim 13 wherein each of said precast modules further comprises a vertical recess on the rearward end of each said flange, and a panel edge alignment means on opposite outer vertical edges of each said panel, whereby vertical form members may be aligned with said stacks of modules to define, in combination with said opposing outside surfaces of said flanges on adjacent stacks, all of the vertical column surfaces of said cast-in-place vertical column.

15. The retaining wall system of claim 14 wherein said footing does not follow a straight line, and said adjacent stacks of precast modules are disposed in relation to one another to form more than one kind of vertical column cross sectional shape, whereby a nonlinearly disposed wall is formed.

16. A method of building a retaining wall system, comprising the steps of:
(a) building a continuous, reinforced footing, said footing having vertically extending spaced apart groups of reinforcing rods;
(b) vertically stacking, between successively spaced groups of said reinforcing rods, precast modules, each module having exposed horizontally transverse rods on opposite ends of each said module wherein said transverse rods are embedded in side faces of a vertical recess and are exposed by transversing said vertical recess on an outer surface of a rearwardly projecting flange located on each opposite end of said module, opposing ends of said modules defining two faces of a vertical column space surrounding said reinforcing rods;
(c) closing the remaining open faces of said column area with vertical forms;
(d) pouring concrete into said column space thereby interlocking said exposed transverse rods of said modules and said vertically extending reinforcing rods of said footing.

17. The method of claim 16 wherein said precast modules are vertically stacked between said successively spaced groups of reinforcing rods such that each vertical stack of precast modules is positioned on said footing so that said vertically extending reinforcing rods occupy a position relatively rearwardly in said column space.

* * * * *